US007416492B2

(12) United States Patent
Wesley

(10) Patent No.: US 7,416,492 B2
(45) Date of Patent: Aug. 26, 2008

(54) GOLF CLUBFACE SWING TRAINER

(76) Inventor: Dave Wesley, 21 Anana, Rancho Santa Margarita, CA (US) 92688

( * ) Notice: Subject to any disclaimer, the term of this patent is extended or adjusted under 35 U.S.C. 154(b) by 0 days.

(21) Appl. No.: 11/391,426

(22) Filed: Mar. 29, 2006

(65) Prior Publication Data

US 2007/0238541 A1 Oct. 11, 2007

(51) Int. Cl.
*A63B 69/36* (2006.01)

(52) U.S. Cl. ..... 473/226; 473/219

(58) Field of Classification Search ..... 473/219, 473/223, 226, 231, 233
See application file for complete search history.

(56) References Cited

U.S. PATENT DOCUMENTS 3,776,556 A 12/1973 McLaughlin
4,569,525 A 2/1986 Folger
4,949,971 A * 8/1990 Thornton ..... 473/238
5,234,217 A 8/1993 Johnson
5,310,188 A 5/1994 Hernberg
5,527,039 A * 6/1996 Levesque ..... 473/226
5,890,977 A 4/1999 Taylor
6,895,680 B2 * 5/2005 Spencer et al. ..... 33/508

* cited by examiner

*Primary Examiner*—Nini Legesse
(74) *Attorney, Agent, or Firm*—Charles S. Gumpel

(57) ABSTRACT

The Golf Clubface Swing Trainer is a dedicated practice golf club designed exclusively to aid golfers understand and correct flaws in the concept of the clubface by helping them recognize what an open, closed and square clubface is at any point in the swing. Additionally, it is deigned to help golfers stretch, develop, and strengthen his or her muscles by swinging the trainer, which is weighted and balanced to achieve that purpose. The Golf Clubface Swing Trainer accomplishes these objectives by use of a weighted, rectangular cross section block shaped clubface orientation aid integral to and concentrically located between the grip and the shaft. The clubface orientation aid incorporates contrasting colors, lettering and indicia, all clearly visible to the golfer during the entire practice swing process, from address, backswing, downswing and follow-through, thus allowing him or her to make the necessary adjustments and corrections. As a further aid for golfers, the Golf Clubface Swing Trainer incorporates a colored grip designed to provide instruction on the proper positioning of the hands during the swing process.

5 Claims, 5 Drawing Sheets

GOLF CLUBFACE SWING TRAINER

BACKGROUND OF THE INVENTION

1. Field of the Invention

The present invention relates generally to golf swing training devices. More particularly, the present invention relates to a golf club swing training device incorporating various features designed to help golfers practice and develop swing paths that will drive the ball in the desired line of flight.

2. Description of Related Art

The game of golf is one of the most popular, albeit frustrating sports in the world. It is played by countless individuals who continually strive to improve their scores by means of instruction, practice and by the use of teaching aids. To those familiar with the game, golf aids, attachments, books, films, and numerous miscellaneous devices are readily available to help lower one's score. As examples, the following United States patents disclose various types of golf club swing training devices: U.S. Pat. Nos. 4,569,525 (Folger); 3,776,556 (McLaughlin); 5,234,217 (Johnson); 5,310,138 (Hernberg); and 5,890,977 (Taylor).

The apparatus disclosed by Folger comprises a simulated golf club that utilizes a square shaft and a pyramidal shaped indicator above the club's grip. The sides are oriented such that when the user is addressing a golf ball, he sees only one side of the shaft and one side of the indicator if and only if the club is in the correct position and attitude. Additionally, the indicator will point toward the user's middle torso if the club is in the correct position.

McLaughlin discloses use of a tear drop shaped body containing a pair of pitched whistles that are attached to the shaft of a golf club. The whistles are designed to sound when the club's swing is such that a slice or hook will result. The proper club swing is achieved when the whistles stop sounding.

Johnson's apparatus comprises a golf club shaft having a plurality of linearly extending alignment indicia located within the lower half of the shaft. In the process of the swing, the golfer views the indicia which assist him in aligning the club so as to produce shots of incremental amounts of hook and slice.

The apparatus disclosed by Hernberg comprises a finned member for securement to the shaft of a conventional golf club. Some of the fins are colored to provide a visual feedback to the golf player of his grip during the stroke so as to maintain proper alignment of the golf clubface and the golf ball while also increasing the air resistance the player encounters during the stroke.

Taylor discloses a golf club shaft which incorporates or to which is attached one or two surfaces extending normal to the clubface and including contrasting indicia on the surfaces with respect to surfaces which extend parallel to the clubface. The shaft may be circular or rectangular and may include a hand grip with a flat thumbrest surface, with contrasting indicia provided on opposite sides of the shaft and extending in a place perpendicular to the ball contact face. The contrasting indicia are then used to provide for aligning the clubface to the plane substantially perpendicular to a predetermined ball trajectory.

Although the aforementioned references appear suitable for their intended purpose, they nevertheless suffer from one or more of the following drawbacks:

- All include apparatus attached or otherwise incorporated onto conventional golf clubs and thus are not designed to serve exclusively as a golf swing training aid usable anywhere.

- All require a complex and instant visual, aural, or mental analysis to evaluate, identify, and attempt to act in response to apparent errors in the golf club swing process.
- None include a multiplicity of readily identifiable orientation features designed to be clearly visible during the entire golf club swing process.
- None incorporate a multiplicity of muscle stretching and strengthening features, provided to improve, other aspects of the golfers club swing.

As can be seen, there is a continuing need for a golf clubface swing trainer designed exclusively for and usable anywhere to aid players, in a simple and uncomplicated manner, to swing the club with the face in a position to strike the ball at right angles to the desired line of flight, while at the same time strengthening and stretching a golfer's muscles.

SUMMARY OF THE INVENTION

In one aspect of the present invention, there is disclosed an apparatus for enabling a golfer to understand and correct flaws in the positioning and orientation of a golf club clubface at any point in the swing, while helping stretch, develop, and strengthen muscles. The apparatus comprises a clubface swing trainer including a grip, a cylindrical shaft extending to an end point hosel, a clubhead extending radially outward, and a golf ball contact clubface located on the club. Integrally secured to the cylindrical shaft is a clubface orientation aid comprising a distinctly colored rectangular cross sectional, block shaped structural element integrally secured, along its entire longitudinal centerline, to the cylindrical shaft. The clubface orientation aid further comprises distinct lettering and indicia on front, back, and outboard surfaces indicating the characteristics and nature of expected golf ball trajectories when those surfaces are seen by the golfer during the entire practice swing process, from address, backswing, downswing and follow-through, thus allowing him or her to make the necessary adjustments and corrections. The clubface swing trainer is shorter than standard golf clubs, is specifically weighted to accommodate differing player requirements, and incorporates a distinctly colored grip to help aid in the positioning of player hands.

In another aspect of the present invention, there is disclosed a clubface swing trainer comprising a grip, a cylindrical shaft extending to an end point hosel, a clubhead extending radially outward, and a golf ball contact clubface located on the clubhead. Integrally secured to the cylindrical shaft is a clubface orientation aid comprising a distinctly colored rectangular cross sectional, block shaped structural element integrally secured, along its entire longitudinal centerline, to the cylindrical shaft. The clubface orientation aid further comprises distinct lettering and indicia on front, back, and outboard surfaces indicating the characteristics and nature of expected golf ball trajectories. The clubface swing trainer is specifically weighted to accommodate differing player requirements, and incorporates a distinctly colored grip to help aid in the positioning of the player's hands.

In still another aspect of the present invention, there is disclosed a method for enabling a golfer to understand and correct flaws in the positioning and orientation of a golf clubface, said method comprising the steps of providing a grip, a cylindrical shaft extending to an end point hosel, a clubhead extending radially outward, and a golf ball contact clubface located on the clubhead. Further steps provide a clubface orientation aid comprising a distinctly colored rectangular cross sectional, block shaped structural element integrally secured to the cylindrical shaft, and incorporating distinct lettering and indicia on front, back, and outboard surfaces indicating the characteristics and nature of expected golf ball trajectories.

These and other features, aspects, and advantages of the present invention will become better understood with reference to the following drawings, descriptions, and claims.

DETAILED DESCRIPTION

The following detailed description is of the best currently contemplated modes of carrying out the invention. The description is not given in a limiting sense, but is merely made for the purpose of illustrating the general principles of the invention, since the scope of the invention is best defined by the appended claims.

The present invention generally provides a weighted and balanced golf clubface swing trainer designed exclusively for and usable anywhere to aid golfers accomplish the following two things:

- Understand and correct flaws in the concept of the clubface by helping the golfer understand what an open, closed and square clubface is at any point in the swing.
- Helps the golfer stretch, develop, and strengthen his or her muscles by swinging the trainer, which may be weighted and balanced to achieve that purpose.

The golf clubface swing trainer is a dedicated training aid and is not comprised of gadgets or attachments appended to golf clubs intended to be used while actually playing the game of golf.

The alignment of a golf club's clubface is the most important factor in determining the behavior of every shot hit by a golfer. Specifically, if the face of the club "looks" to the right or to the left of the intended target as the ball is struck, the golfer's instinctive reactions to the ball's actual line of flight will create errors in the swing path and angle of attack, while also impairing clubhead speed.

Figure 1:
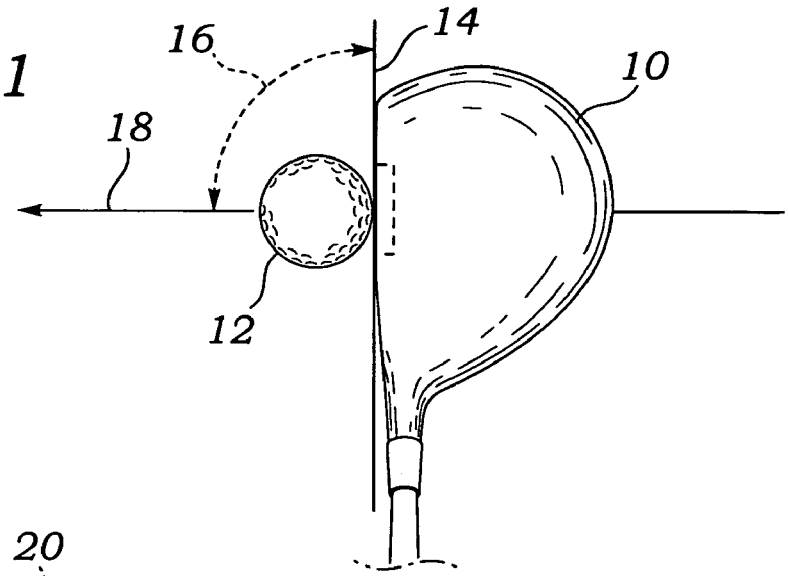
FIG. 1 is a top view of a golf ball the instant it is struck squarely with a golf clubhead.

These conditions are best illustrated in the accompanying drawings (in which like reference numerals indicate like parts throughout several views). All said drawings conveniently illustrate golf club heads for right-handed players, but it is understood that all descriptions and inventive embodiments apply equally to golf club heads designed for left-handed players and right-hand players. Referring first to FIG. 1 there is shown a golf clubhead (10) the instant it strikes a golf ball (12) with the bottom leading edge of the clubface (14) being at a 90° angle (16) to the target line (18). The condition illustrated in FIG. 1 will cause the golf ball (12) to travel along the target line (18), which is the desired line of flight.

Figure 2:
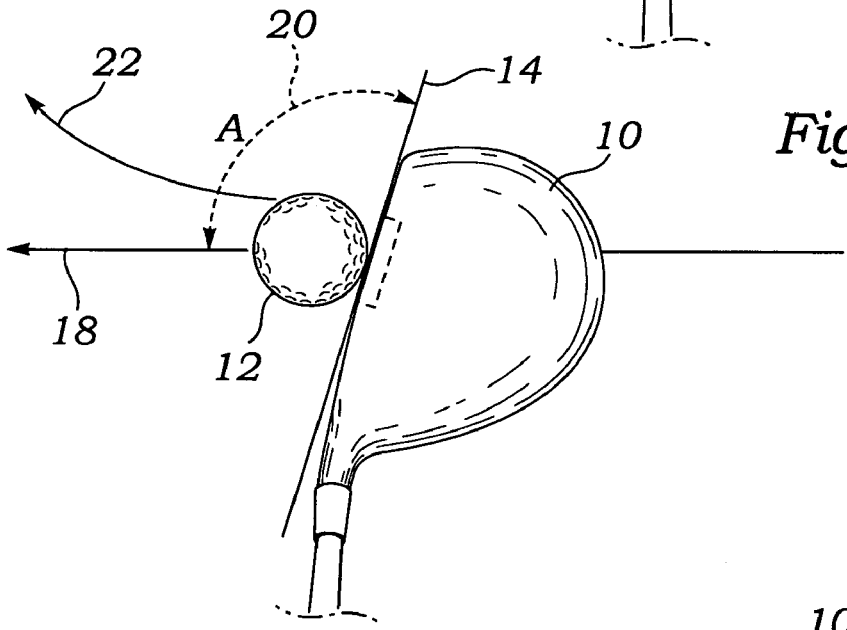
FIG. 2 is a top view of a golf ball the instant it is struck with the golf clubhead looking to the right of the target at impact.

Referring now to FIG. 2, there is shown the same golf clubhead (10) the instant it strikes the golf ball (12) with the bottom leading edge of the clubface (14) being at angle A (20) to the target line (18), said angle A (20) measuring in excess of 90°. The clubface (14) is looking to the right of the target line (18) at impact, or in golfing terminology, it is said to be "open", producing a line of flight (22), which is to the right of the target line (18). The line of flight (22) is also referred to as a "slice". It is known that most players who slice the golf ball (12) put their clubface (14) in an open position not only during impact but also during other portions of the entire swing.

Figure 3:
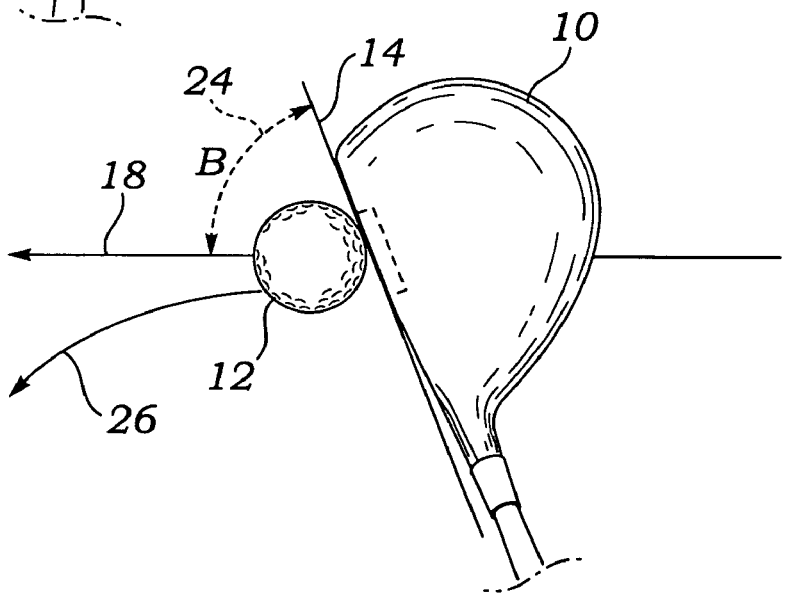
FIG. 3 is a top view of a golf ball the instant it is struck with the golf clubhead looking to the left of the target at impact.

Referring now to FIG. 3, there is again shown the same golf clubhead (10) the instant it strikes the golf ball (12) with the bottom leading edge of the clubface (14) being at angle B (24) to the target line (18), said angle B (24) measuring less than 90°. The clubface (14) is looking to the left of the target line (18) at impact, or in golfing terminology, it is said to be "closed", producing a line of flight (26), which is to the left of the target line (18). The line of flight (26) is also referred to as a "hook". It is known that most players who hook the golf ball (12) put their clubface (14) in a closed position not only during impact but also during other portions of the entire swing.

Figure 4:
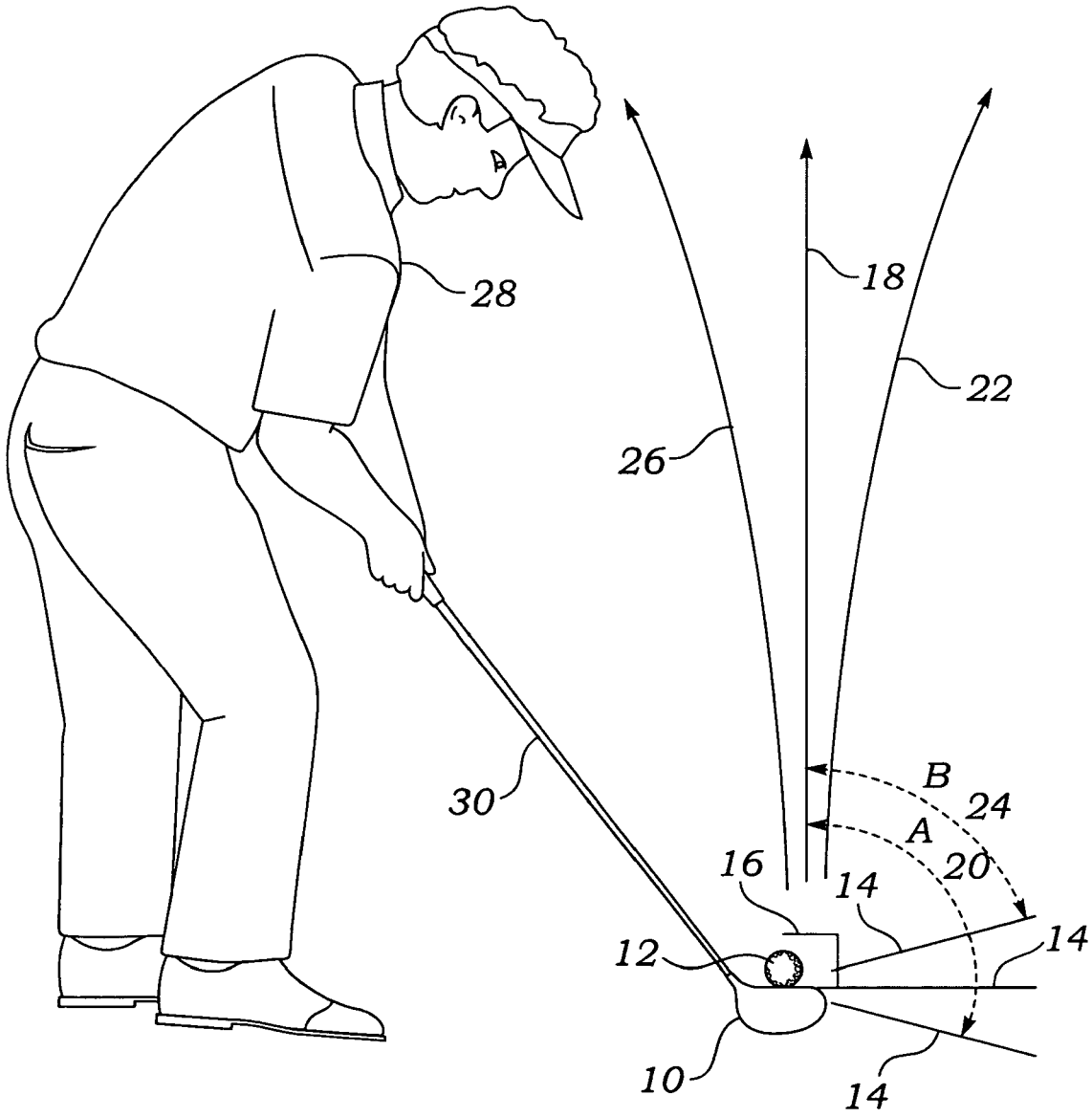
FIG. 4 is an illustration of a golfer addressing a ball with a golf club and showing three distinctly different flight paths resulting from clubhead orientation.

FIG. 4 illustrates a golfer addressing a ball with a golf club (30) and showing the three distinctly different flight paths (discussed above) resulting from clubhead (10) orientation. The golfer (28) is shown swinging the golf club (30) such that the bottom leading edge of the clubface (14) is at a 90° angle (16) from the target line (18), which is the preferred line of flight. On FIG. 4, the clubhead (10) is shown in the position preferred by golfers. However, if the clubface (14) is rotated to the open position, to angle A (20), the line of flight (22) will be a slice, whereas if is rotated to the closed position, to angle B (24), the line of flight (26) will be a hook. Alignment of the clubface (14) is considered to be the most important impact factor in the game of golf. Alignment is critical because if the clubhead (10) looks to the left or right of the target as the golf ball (12) is struck, the golfer's (28) instinctive awareness resulting from incorrect angles inhibits free and forceful swinging, which reduces clubhead (10) speed. (Reference: "The Golf Swing Simplified", John Jacobs, Lyons and Burford Publishers, 1993).

Figure 5:
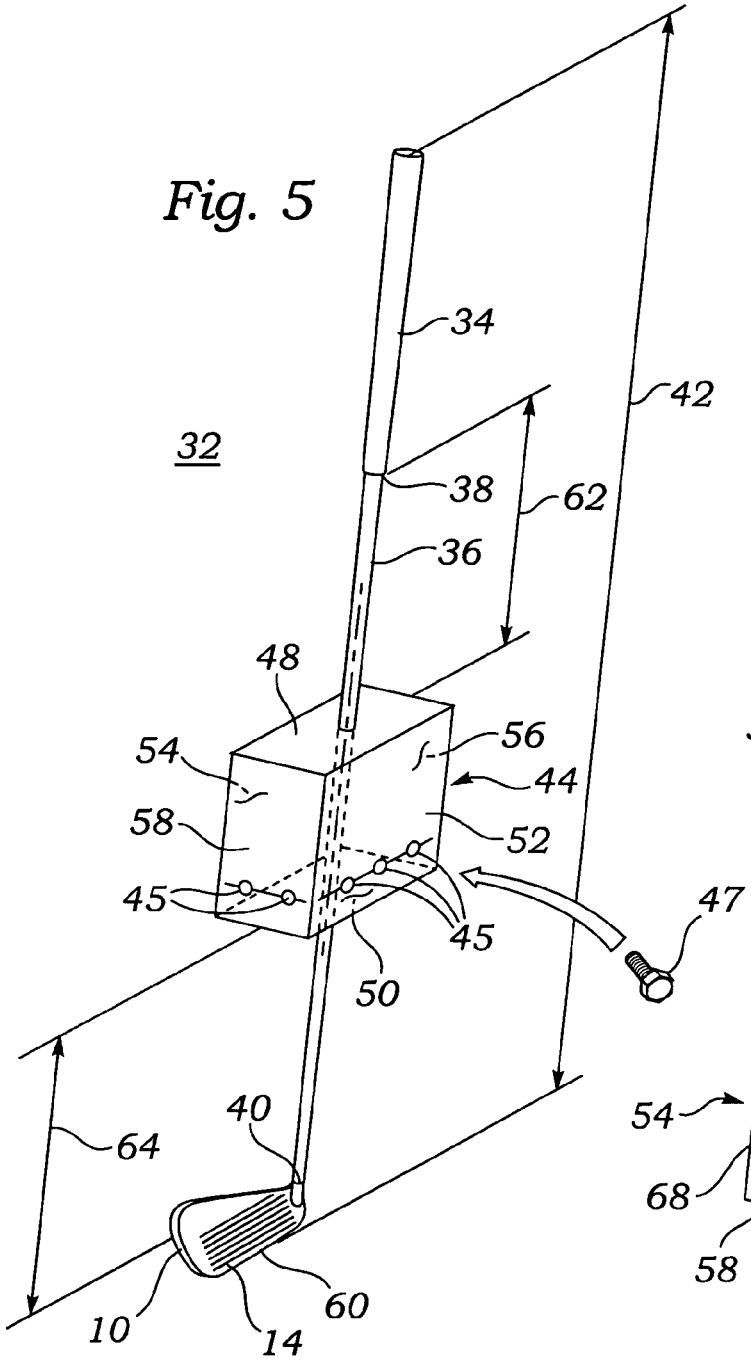
FIG. 5 is a perspective view of a golf clubface swing trainer in accordance with an embodiment of the present invention.

Referring now to FIG. 5, there is illustrated an embodiment of the inventive golf clubface swing trainer, generally designated by the numeral (32). Said clubface swing trainer (32) incorporates a handle area or grip (34) generally of the size, shape and location as used for conventional regulation golf clubs. Extending axially outward from the lower end of said grip (34) is a cylindrical shaft (36), which, as with conventional golf clubs, gradually tapers in diameter from the top (38) to the end point or hosel (40). The connecting point between shaft (36) and clubhead (10) is commonly identified by those skilled in the art as the hosel (40). Attached to and extending radially outwardly beyond the end point hosel (40) of said shaft (36) is a conventional clubhead (10) having a ball contact clubface (14). The overall length (42) of clubface swing trainer (32) may be from about 18 to about 32 inches, that being shorter that conventional golf clubs, which generally range from 34 to 50 inches in length. For illustration purposes, a typical iron head is shown on FIG. 5. However, alternate embodiments of the inventive golf clubface swing trainer (32) may use conventional wood heads, sand wedge heads, or putter heads.

Referring still to FIG. 5, clubface orientation aid (44) is shown comprising a generally planar, rectangular cross sectional, block shaped structural element integrally secured, along its entire longitudinal centerline (46), to said shaft (36), said shaft (36) being concentric with said longitudinal centerline (46). Clubface orientation aid (44) further comprises top (48) and bottom (50) surfaces, front (52) and back (54) surfaces, and inboard (56) and outboard (58) surfaces. Clubface orientation aid (44) is oriented radially with respect to clubface swing trainer (32) such that front (52) and back (54) surfaces are generally parallel to the bottom leading edge (60) of the ball contact face of clubface (14) Inboard (56) and outboard (58) surfaces are, thus, generally perpendicular to bottom leading edge (60).

To accommodate diverse training requirements, as addressed below, embodiments of clubface orientation aid (44) may have the following external dimensional and positional configurations:

| | |
|---|---|
| Vertical height, along shaft (36), of front (52), back (54), inboard (56) and outboard (58) surfaces: | From about 5 to 12 inches. |
| Transverse width of front (52) and back (54) surfaces: | From about 2 to 8 inches. |
| Transverse width of inboard (56) and outboard (58) surfaces: | From about 1 to 5 inches. |
| Distance (62) from top surface (48) to lowest extremity of grip (34): | From about being in contact with grip (34) to about 12 inches. |
| Distance (64) from bottom surface (50) to hosel (40): | From about being in contact with hosel (40) to about 5 inches. |

The elements comprising clubface swing trainer (32), including grip (34), shaft (36), clubface orientation aid (44), and clubhead (10), may be manufactured using conventional materials for golf clubs and the like, including but not limited to steel, aluminum, plastics, and reinforced polymers. Clubface orientation aid (44) may be manufactured as a hollow block shaped structural element or may be filled such as by foam or similar materials, proving the total weight of embodiments of clubface swing trainer (32) are in the range of from about 15 to about 45 ounces. The weight variations may be designed and provided to strengthen and stretch a golfer's muscles, with different weights being utilized for different strength payers, as follows:

| | | |
|---|---|---|
| Slow swing speed players (less than 70 mph swing speed). | Total weight of clubface swing trainer (32) may be in the range of 15 to 25 ounces. | Ideal for ladies, children, and seniors. |
| Medium swing speed players (swing speed between 70 and 80 mph). | Total weight of clubface swing trainer (32) may be in the range of 25 to 30 ounces. | Ideal for strong ladies, teenagers, and average strength men. |
| High swing speed players (swing speed between 90 and 100 mph). | Total weight of clubface swing trainer (32) may be in the range of 30 to 35 ounces. | Ideal for stronger players. |
| Very high swing speed players (swing speed over 100 mph). | Total weight of clubface swing trainer (32) may be in the range of 35 to 45 ounces. | Ideal for very strong competitive players. |

For advanced golfer's, further embodiments of clubface swing trainer (32) comprise the addition of movable weights externally positioned on clubface orientation aid (44). Illustrated on FIG. 5, a multiplicity of commonly sized threaded holes (45) may be positioned about the external periphery of clubface orientation aid (44), located on front (52), back (54), inboard (56) and outboard (58) surfaces, said holes sized to accommodate weighted screws (47) that may be placed in various combinations and locations to vary the weight and moment of inertia of clubface swing trainer (32). An example of application of the movable weight system may be placement of weighted screws in certain locations to promote a rolling of the clubface (14) through impact, hereby reducing the tendency to slice or hook the ball.

An even further alternate embodiment of clubface swing trainer (32) may comprise the addition of fixed weights positioned optionally on any one, some, or all of the internal surfaces of front, back, inboard and outboard surfaces (52,54, 56, and 58) of clubface orientation aid (44). The weights (not illustrated) may be optionally secured to said surfaces by means of any one or a combination of commonly known securement techniques, such as welding, bonding, bolting, or the such. The weights may be placed in various combinations and locations to vary the weight and moment of inertia of clubface swing trainer (32) to also promote a rolling of the clubface (14) through impact, hereby reducing the tendency to slice or hook the ball.

Figure 6:
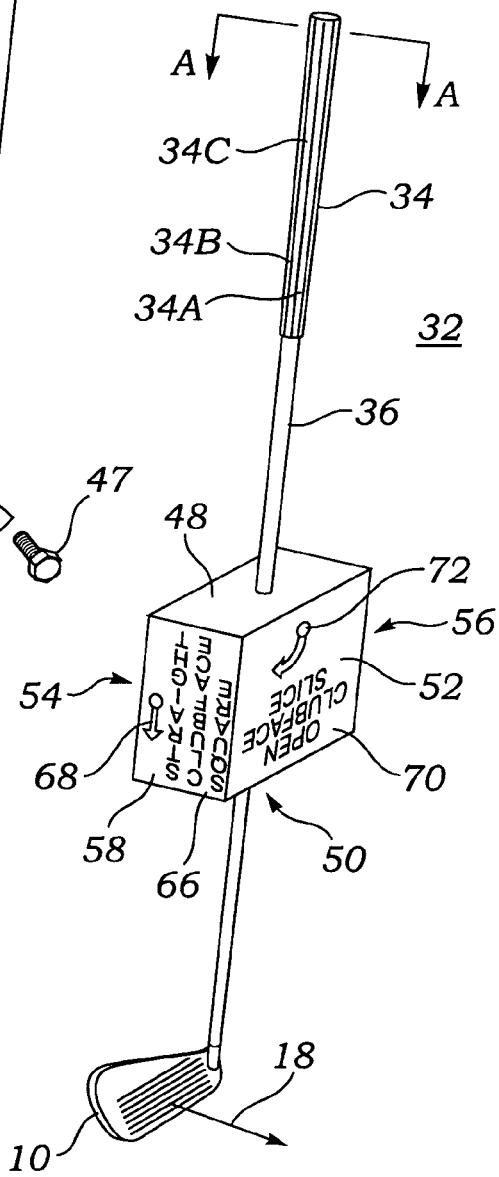
FIG. 6 is another perspective view of a golf clubface swing trainer illustrating external details of an embodiment of the inventive clubface orientation aid.
Figure 7:
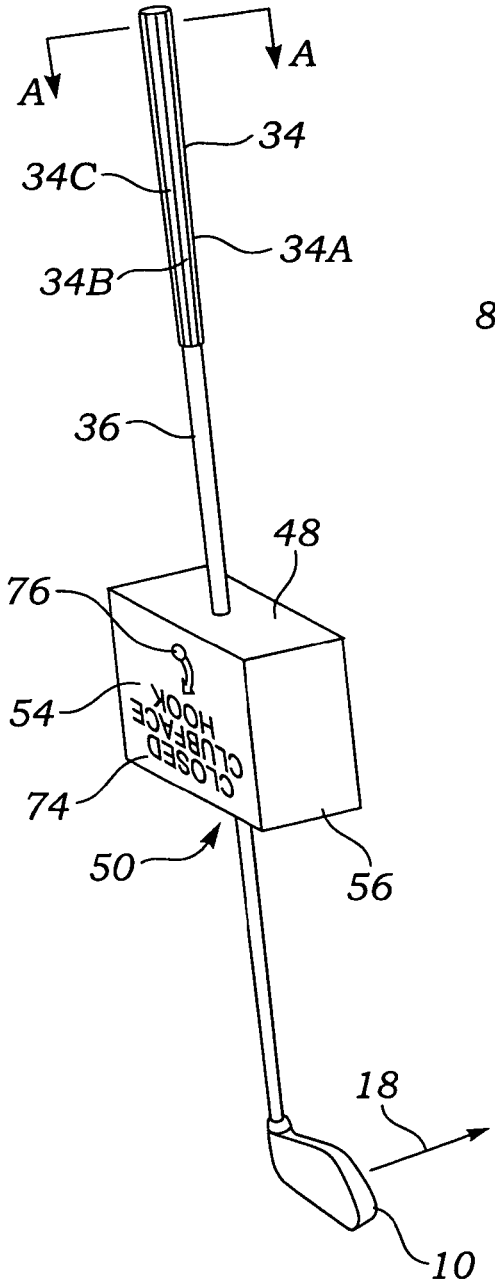
FIG. 7 is yet another perspective view of a golf clubface swing trainer illustrating external details of an embodiment of the inventive clubface orientation aid as seen from the backside of the clubhead.

FIG. 6 is a perspective view of golf clubface swing trainer (32) illustrating an embodiment comprising external color and indicia details of clubface orientation aid (44). FIG. 7 is a similar perspective view, as seen from the backside of the clubhead (10). In one embodiment of the present invention the four surfaces, which are perpendicular to target line (18), namely top (48), bottom (50), inboard (56), and outboard (58) are colored a common color, such as white. Front surface (52) is colored a different contrasting color, such as red, and finally, back surface (54) is colored a further contrasting color, such as green. In another embodiment of the present invention, three different contrasting colors may be used to paint the six external surfaces of clubface orientation aid (44), providing only one common color is employed for surfaces top (48), bottom (50), inboard (56), and outboard (58), and different contrasting colors are employed for each of surfaces front (52) and back (54).

Referring again to FIG. 6, there is shown a further embodiment, which may comprise upper case letters located on outboard surface (58) spelling the words "SQUARE CLUBFACE STRAIGHT" (66), the letters being vertically oriented starting on the clubhead (10) side, and aligned to be parallel to shaft (36). Transversely adjacent to the words "SQUARE CLUBFACE STRAIGHT" (66) may be indicia (68) made to represent a golf ball in straight flight, said indicia (68) comprising a ball and a straight arrow linearly parallel to shaft (36) and pointing toward clubhead (10). The lettering for the words "SQUARE CLUBFACE STRAIGHT" (66) and indicia (68) may be any color different from and contrasting the color of outboard surface (58).

Referring still further FIG. 6, there is shown another embodiment, which may comprise upper case letters located on front surface (52) spelling the words "OPEN CLUBFACE SLICE" (70), the letters being horizontally oriented starting on the clubhead (10) side, and aligned to be parallel to bottom surface (50). Between the words "OPEN CLUBFACE SLICE" (70) and top surface (48) may be indicia (72) made to represent a golf ball in curved (slice) flight, said indicia (70) comprising a ball and a curved arrow generally transverse to shaft (36) and pointing toward clubhead (10). The lettering for the words "OPEN CLUBFACE SLICE" (70) and indicia (72) may be any color different from and contrasting the color of front surface (52).

Referring once again to FIG. 7 illustrating details of clubface orientation aid (44) as seen from the backside of the clubhead (10), there is seen a further embodiment of external details located on back surface (54). Said details may comprise spelling the words "CLOSED CLUBFACE HOOK" (74) in upper case lettering, the letters being horizontally oriented starting on the clubhead (10) side, and aligned to be parallel to bottom surface (50). Between the words "CLOSED CLUBFACE HOOK" (74) and top surface (48) may be indicia (76) made to represent a golf ball in curved (hook) flight, said indicia (76) comprising a ball and a curved arrow generally transverse to shaft (36) and pointing toward clubhead (10). The lettering for the words "CLOSED CLUBFACE HOOK" (74) and indicia (76) may be any color different from and contrasting the color of back surface (54).

Figure 8:
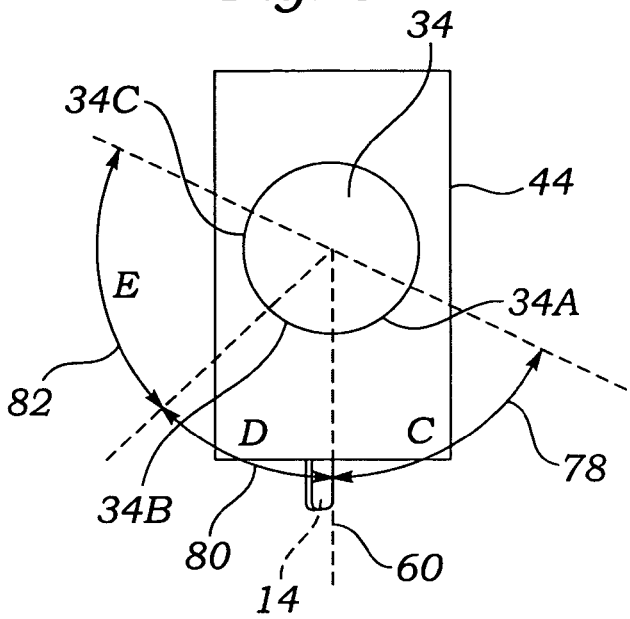
FIG. 8 is a top view of golf clubface swing trainer taken along lines A-A of FIGS. 6 and 7.

Referring now to FIG. 8, there is shown a top view of golf clubface swing trainer, taken along line A-A of FIGS. 6 and 7, illustrating a further embodiment of the present invention involving unique color coding of grip (34). The view illustrates the vertical positioning of grip (34) and clubface orientation aid (44) in relation to clubface (14). As seen, the longitudinal centerline of clubface orientation aid's (44) top surface (48) may be aligned to be parallel to the bottom leading edge (60) of the ball contact surface of clubface (14). The unique grip (34) color coding scheme (also illustrated on FIGS. 6 and 7) comprises three external surface, radially bounded sections extending the full length of said grip (34). The first grip section (34A), may be colored the same color as front surface (52), the second grip section (34B) may be colored the same color as outboard surface (58), and the third grip section (34C) may be colored the same color as back surface (54). First grip section (34A) may be bounded radially by angle C (78) measured counterclockwise from bottom leading edge (60), second grip section (34B) may be bounded radially by angle D (80) measured clockwise from bottom leading edge (60), and third grip section (34C) may be bounded radially by angle E (82) measured clockwise from the clockwise extremity of angle D (80). Each of said angles C, D, and E, (78, 80 and 82) may be substantially equally sized and may measure in the range of 40 to 45 degrees.

The color coded grip (34) illustrated on FIG. 8 helps the player put his hands on the club correctly, the colored grip section being where the golfer's left thumb is placed. If the golfer puts his left thumb on second grip section (34B), corresponding to the color of top surface (58), the position of his left hand will help promote a square clubface throughout the golf swing. If the player places his left hand to far to the left, his thumb will be on first grip section (34A), corresponding to the color of front surface (52). To those skilled in the art, said positioning is called a slice/weak golf grip, a grip that promotes an opening of the clubface throughout the swing, thus producing a slice. Finally, when the player places his hand too far to the right, his left thumb will be on third grip section (34C). To those skilled in the art, said positioning is called a hook/strong golf grip, a grip that promotes a closing of the clubface throughout the swing, thus producing a hook.

As will be appreciated by those skilled in the art, a clubface swing trainer (32) equipped with a clubface orientation aid (44) and uniquely color coded grip (34), as above described, provides an indispensable training aid for golf players who have a tendency to slice or hook golf balls as a result of clubface (14) misalignment. Operational aspects of the clubface swing trainer are described below.

Figure 9A:
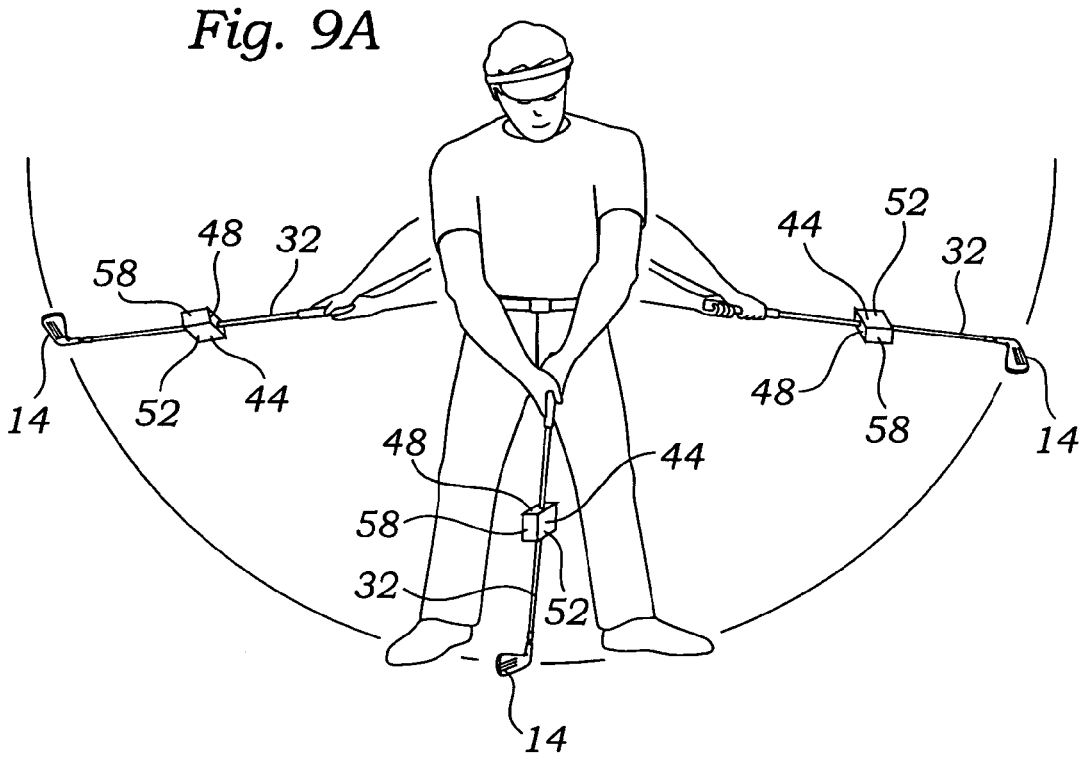
FIG. 9A is a front elevation showing the functioning of an embodiment of the inventive clubface swing trainer with the golfer employing an open clubface; and, FIG. 9B is a front elevation showing the functioning of an embodiment of the inventive clubface swing trainer with the golfer employing a closed clubface.

FIG. 9A is a front elevation of a golfer swinging the clubface swing trainer (32) in the open position, as the clubface (14) is said to be looking to the right of the target at impact. The result will be a slice. Most players who slice the ball put their clubface (14) in an open position, not only at impact, but during other portions of the entire swing. When the slicer takes the club away from the ball during the back swing, there is a tendency to rotate the clubface in a clockwise manner. In the process, however, the golfer will see clubface orientation aid (44) front surface (52) which may comprise a contrasting color as well as lettering (70) and indicia (72), all indicating that a slice will be produced. As long as the clubface remains in the open position, the same conditions will exist during the downswing, at impact, and during the follow through. What the golfer needs to do to correct this condition is to not only have a square clubface (14) at impact, but to also develop a square clubface (14) during the entire swing process, i.e., at address, during the backswing, at the top of the backswing, during the downswing, at impact, and during the follow-through. This objective may be achieved by making numerous practice swings at home or anywhere else with the clubface swing trainer (32). During the practice swing process, the golfer will not want to see front surface (52) with its contrasting color, lettering (70) and indicia (72), but instead will want to see top surface (48) and outboard surface (58), the latter comprising a contrasting color, lettering (66), and indicia, all indicating that the clubface is being maintained square to the desired line of flight. Because of the controlled weight of the clubface swing trainer (32), during the practice swing process, the golfer will have the added benefit of muscle stretching and strengthening.

Figure 9B:
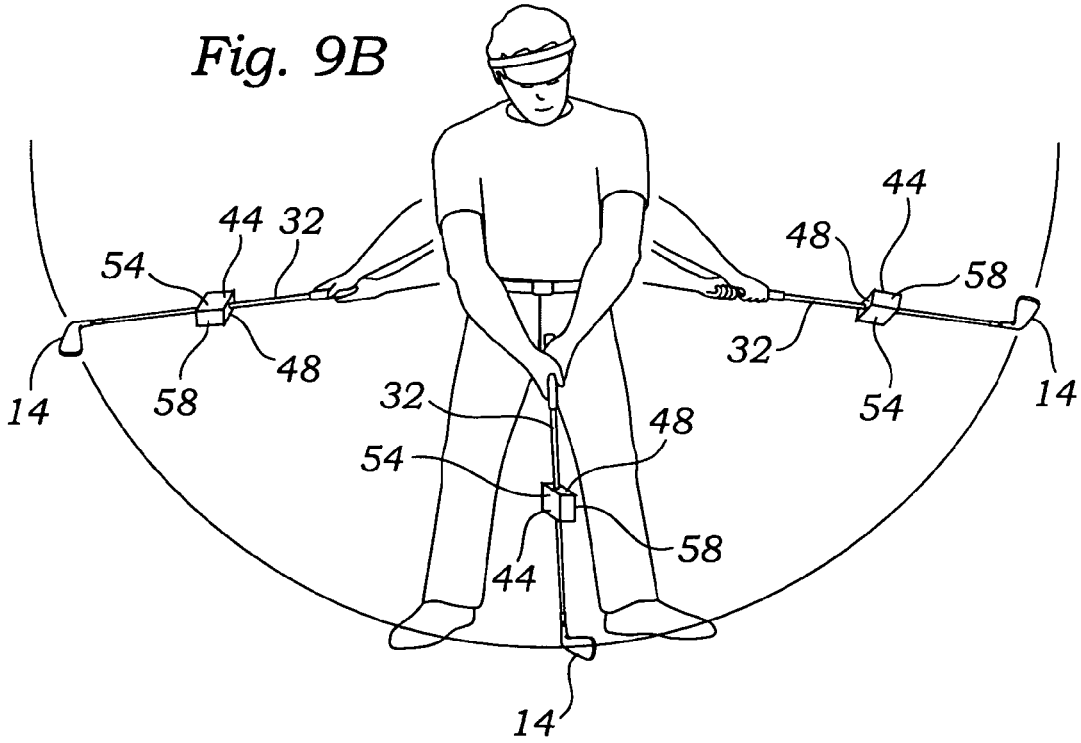

FIG. 9B is a front elevation of a golfer swinging the clubface swing trainer (32) in the closed position, as the clubface (14) is said to be looking to the left of the target at impact. The result will be a hook. Most players who hook the ball put their clubface (14) in a closed position, not only at impact, but also during other portions of the entire swing. When the golfer who habitually hooks the ball takes the club away from the ball during the back swing, there is a tendency to rotate the clubface in a counter clockwise manner. In the process, however, the golfer will see clubface orientation aid (44) back surface (54) which comprises a contrasting color as well as lettering (74) and indicia (76), all indicating that a hook will be produced. As long as the clubface remains in the closed position, the same conditions will exist during the downswing, at impact, and during the follow through. What the golfer needs to do to correct this condition is to not only have a square clubface (14) at impact, but to also develop a square clubface (14) during the entire swing process, i.e., at address, during the backswing, at the top of the backswing, during the downswing, at impact, and during the follow-through. This objective may be achieved by making numerous practice swings at home or anywhere else with the clubface swing trainer (32). During the practice swing process, the golfer will not want to see back surface (54) with its contrasting color, lettering (70) and indicia (72), but instead will want to see top surface (48) and outboard surface (58), the latter comprising a contrasting color, lettering (66), and indicia, all indicating that the clubface is being maintained square to the desired line of flight. Because of the controlled weight of the clubface swing trainer (32), during the practice swing process, the golfer will have the added benefit of muscle stretching and strengthening as well as optional use of weights to promote a rolling of the clubface (14) through impact, hereby reducing the tendency to slice or hook the ball.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A golf clubface swing trainer comprising:

a) a grip, b) a cylindrical shaft, c) a clubhead, d) a ball contact surface located on said clubhead, e) a clubface orientation aid having a planar, rectangular cross sectional, block shaped structural element integrally secured, along its entire longitudinal centerline, to said cylindrical shaft, said cylindrical shaft being concentric with said longitudinal centerline, and further comprising top and bottom surfaces, front and back surfaces, and inboard and outboard surfaces, with said front and back surfaces being generally parallel to the bottom leading edge of said ball contact clubface, and f) wherein three contrasting external colors are employed for said top and bottom, front and back, and inboard and outboard surfaces with one common color being employed for said top, bottom, inboard and outboard surfaces, and a different color being employed for each of said front and back surfaces.

2. The golf clubface swing trainer of claim 1, further comprising three external surface, radially bounded, sections of said grip extending along the full length of said grip, the first grip section, colored the same color as said front surface, the second grip section colored the same color as said outboard surface, and the third grip section colored the same color as said back surface.

3. The golf clubface swing trainer of claim 1, further comprising: said first grip section bounded radially by an angle ranging from 40 to 45 degrees measured counterclockwise from said bottom leading edge of said ball contact clubface; said second grip section bounded radially by an angle ranging from 40 to 45 degrees measured clockwise from said bottom leading edge of said ball contact clubface; and, said third grip section bounded radially by an angle ranging from 80 to 90 degrees measured clockwise from said bottom leading edge of said ball contact clubface.

4. A golf clubface swing trainer apparatus, comprising a grip, a cylindrical shaft extending axially outward from the lower end of said grip to an end point hosel, a clubhead extending radially outward beyond said end point hosel, a golf ball contact clubface located on said clubhead and having a ball contact bottom leading edge, a rectangular cross sectional block shaped clubface orientation aid longitudinally, integrally, and concentrically secured to said cylindrical shaft, said clubface orientation aid further comprising top, bottom, front, back, inboard and outboard surfaces, with said front and back surfaces being generally parallel to said bottom leading edge of said ball contact surface;

wherein contrasting external colors are employed for said top and bottom, front and back, and inboard and outboard surfaces with one common color being employed for said top, bottom, inboard and outboard surfaces, and a different color being employed for each of said front and back surfaces.

5. The apparatus of claim 4, further comprising external surface, radially bounded, sections of said grip extending along the full length of said grip, the first grip section, colored the same color as said front surface, the second grip section colored the same color as said outboard surface, and the third grip section colored the same color as said back surface.

* * * * *